United States Patent [19]

Katakura

[11] 3,990,394

[45] Nov. 9, 1976

[54] CONTROL CIRCUIT USED IN DEVELOPMENT OF ELECTROSTATIC LATENT IMAGES AND DEVELOPING APPARATUS

[75] Inventor: Hiroshi Katakura, Hachioji, Japan

[73] Assignee: Konishiroku Photo Industry Co., Ltd., Japan

[22] Filed: Aug. 21, 1974

[21] Appl. No.: 499,336

[30] Foreign Application Priority Data

Aug. 27, 1973 Japan ..... 48-95296

[52] U.S. Cl. ..... 118/637

[51] Int. Cl.[2] ..... G03G 15/09

[58] Field of Search ..... 118/637; 355/3 DD; 117/17.5

[56] References Cited

UNITED STATES PATENTS

| | | | |
|---|---|---|---|
| 3,117,884 | 1/1964 | Greig | 355/3 DD |
| 3,152,012 | 10/1964 | Schaffert | 355/3 DD |
| 3,262,806 | 7/1966 | Gourge | 118/637 |
| 3,355,288 | 11/1967 | Matkan | 118/637 |
| 3,405,682 | 10/1968 | King et al. | 118/637 |
| 3,599,605 | 8/1971 | Ralston et al. | 118/637 |
| 3,601,092 | 8/1971 | Satomi | 118/637 |
| 3,627,523 | 12/1971 | Shelffo | 355/3 DD |
| 3,741,760 | 6/1973 | Snelling | 118/637 |

*Primary Examiner*—Mervin Stein
*Assistant Examiner*—Douglas Salser
*Attorney, Agent, or Firm*—Bierman & Bierman

[57] ABSTRACT

A control circuit used in the development of electrostatic latent images which applies a suitable biasing voltage to a magnetic brush developing unit to alleviate problems of fogging and breakdown of the photosensitive layer. The effective biasing voltage remains unchanged as the characteristics of the developer, such as electric resistivity, change with increased use.

4 Claims, 2 Drawing Figures

CONTROL CIRCUIT USED IN DEVELOPMENT OF ELECTROSTATIC LATENT IMAGES AND DEVELOPING APPARATUS

This invention relates to a control circuit used in development of electrostatic latent images and developing apparatus.

In general, in electrophotography an electrostatic latent image is formed on the surface of a photoconductive insulate layer by means of a known method, that is, electric charging and imagewise exposure.

In this method, however, electrostatic charge is left on the area which is exposed to a light and which should result in a white portion after developing, so that a toner deposits on the area exposed to light. Because of this, a fog occurs in the known development. In cases, the potential of the residual charge is several tens to hundreds volt.

Further, according to another known method, a D.C. voltage is applied to a magnetic brush to remove the residual charge and thereby prevent the deposition of the toner on the exposed area.

This is called a biasing control method.

This method is, for example, such that a support for a photosensitive layer bearing electrostatic latent images of negative polarity thereon is maintained at earth potential and a negative D.C. biasing voltage is applied to a magnetic brush to establish an electric field preventing the deposition of the toner.

In this case, there will be a limitation of the range of the applied voltage. This is because although a high voltage is desired to reduce the density in the exposed area and thereby obtain images of high contrast, when too high a voltage is applied, electric breakdown of the photosensitive layer tends to occur, and on the other hand, with too low a voltage, contrast of the image will be reduced.

In a magnetic brush development, a biasing control voltage is applied mostly through the magnetic brush.

In such magnetic brush development, no consideration has been taken of the change in the characteristics of the developer, for example electric resistivity, with use.

The resistivity increases with the use of a developer. As the result, fog is increased.

This increase of fog is due to the reduction of an effective biasing voltage.

This effective voltage is termed as the voltage impressed to the toner interposed between the surface of the photoconductive layer and the carrier in the developer.

Therefore, an object of this invention is to overcome the defects in conventional developments.

Another object of this invention is to prevent occurance of fogs with use of the developer.

Still another object of this invention is to provide a control circuit used in development of electrostatic latent images which can apply a most suitable biasing voltage to the magnetic brush and bring about no breakdown of the photosensitive layer.

The present invention will be described with reference to the following description and accompanied drawings.

Figure 1:
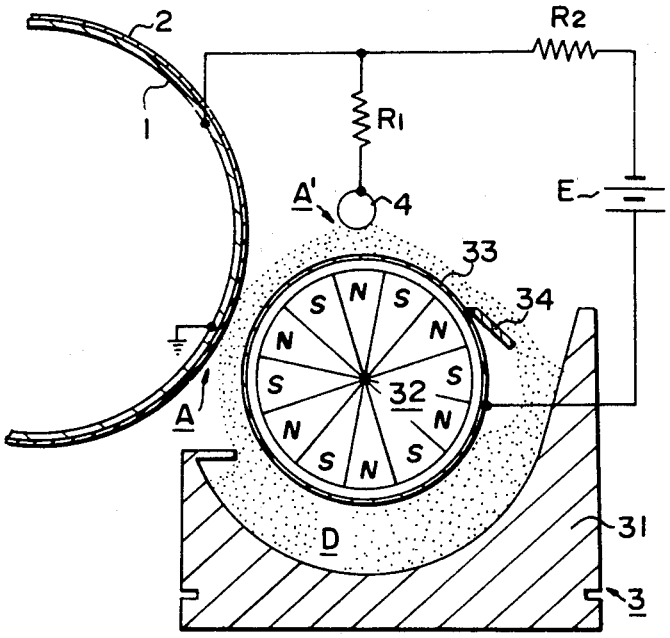
FIG. 1 is a schematic view of an embodiment of this invention.
Figure 2:
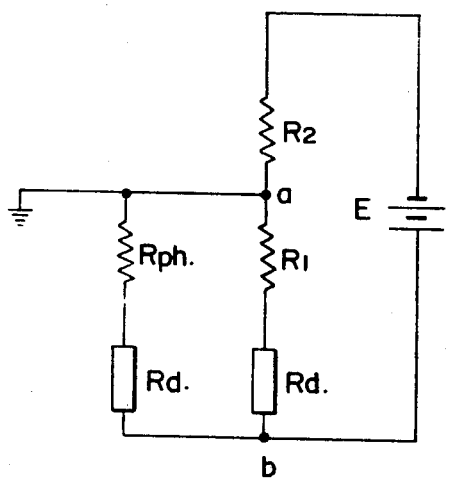
FIG. 2 is an equivalent circuit of that shown in FIG. 1.

In FIG. 1 reference numeral 1 designates a conductive drum carrying a photoconductive insulating layer 2 and bed with earth potential. The drum 1 is adapted to rotate clockwise. The photoconductive insulating layer 2 consists of: for example, zinc oxide dispersed in a binder of insulating resin and has an electrostatic latent image of negative polarity formed thereon. Reference numeral 3 indicates a magnetic brush developing device. The device 3 has a base portion 31 having the form of a circle so that developer D may be stored and moved smoothly. The device 3 has also a bent portion at the left end thereof in the vicinity of the drum 1 for forming a uniform developer layer on a sleeve 33. The developer D comprises an electroconductive and magnetic carrier (iron powder) and a toner the latter belonging to a group of the triboelectric series capable of obtaining positive electric charges by triboelectric charging with the carrier. For instance, in case alcoholized iron is used as a carrier, powdered shelac or rosin which has been colored with a suitable material such as carbon black may be used. Reference numeral 32 designates a permanent magnet of cylindrical type (merely referred to as a magnet hereinafter) circumferentially covered with a sleeve 33 with both ends thereof fixedly held on the side plates (not shown) of the base portion 31. Furthermore, many magnet pieces are arranged so that alternate poles appear on the circumferential surface and N-pole having a larger magnetic force at the developing position A and the controlling position A′, than the ambient force. The magnet 32 does not necessarily have to be cylindrical, as the magnet has only to be active at its half portion on the left hand side. The sleeve 33 has a surface having a developer and consists of a conductive and non-magnetic material, for example, brass disposed with a small distance between itself and the magnet 32. The sleeve 33 is driven by a driving means (not shown) to rotate in the opposite direction to that of the drum 1. Reference numeral 34 is a scraper for scraping the developer D from the surface of the sleeve 33 after development. 4 indicates a conductive contact terminal having substantially equally axial length to that of the sleeve 33 and the contact terminal 4 is arranged to make contact with the developer to such extent that the contact terminal 4 dips in the magnetic brush. It is desired that the relationship between the contact terminal 4 and the developer layer should be equal to the relationship between the drum 1 in the developing position A and the developer layer. In the embodiment shown in the present invention, the thickness of the developer layer at the both positions A and A′ was set to about 6 ~ 8 mm and the contact depth was set to about 0.5 mm. It is to be noted that the magnet 32 is made as abovementioned in connection with relationship between the drum 1 and the contact terminal 4. In more detail, the magnet 32 is made so that it may provide the arrangement in which the developer D may touch softly to the drum 1 side in the position A and that the developer is prevented from staying in the neighbourhood in the position A′. Therefore, if these considerations are not necessary, a constant magnetic force will be sufficient over the entire surface of the magnet. $R_1$ is a controlling resistor. For example, Resistivity of $R_1$ is set to 1 MΩ. $R_1$ has its one end connected to the contact terminal 4 and another end connected in series with a safety resistance $R_2$. An optimum biasing voltage is obtained by adjusting the resistivity of the resistor $R_2$. For example, $R_2$ is set to 1 MΩ. A constant D.C. voltage Vc is applied between the sleeve 33 and one end of the safety resistor $R_2$. E indicates an electric source and is set to for example, −300 volts. The intermediate point between the resistors $R_1$ and $R_2$ is grounded through the drum 1 as shown in the figures. Both resistances $R_1$ and $R_2$ are determined by the constant voltage Vc, the breakdown voltage of the photoconductive layer 2 and the residual potential of the surface of the layer 2. Arrangement is made such that the constant voltage Vc is applied coincidently with rotation of the sleeve 33 through a switch means (not shown). FIG. 2 represents an equivalent circuit diagram of FIG. 1. In the drawing, Rph represents internal resistance of the layer 2 and Rd is internal resistance of the developer layer in the developing position A and the controlling position A′. The resistance Rd varies due to change in configuration of a carrier itself in the developer, the amount of an attached toner and its attachment condition. However, as the condition of the developer in either positions A or A′ as abovementioned was set to be equal, the value of internal resistances of the developer in the either positions A and A′ can be regarded to be almost equal. As seen from the drawing, if it is assumed that a current flowing in a circuit of $R_1 \cdot Rd$ (controlling circuit) be $i_1$ and a current flowing in a circuit of Rph · Rd (developing circuit) be $i_2$, the equation $$i_1 (R_1 + Rd) = i_2 (Rph + Rd) \quad (1)$$

will result. The internal resistance Rph of the photoconductive layer 2 is of the order of $10^{12}$ to $10^{15}\Omega$ cm in a dark atmosphere which is very large as compared with the controlling resistance $R_1$, and most part of the current will flow in the branch of the controlling circuit $R_1 \cdot Rd$.

Accordingly, the images on the layer 2 is subjected to no influence by the current. It follows, therefore, that the effective biasing voltage is determined by the potential difference between the points *a* and *b* as shown in FIG. 2. If it is assumed that the resistance Rph is very large the biasing voltage VB applied between the potential *a* of the drum 2 and the potential *b* of the sleeve 33 will be $$VB = \frac{Rd + R_1}{Rd + R_1 + R_2} \times Vc \quad (2)$$

where

VB = biasing voltage (V)
Rd = resistance of the developer
$R_1$ = controlling resistance
$R_2$ = safety resistance
Vc = constant voltage and assuming that Rd is very small, $R_1$ and $R_2$ are $1M\Omega$ and Vc is 300V, VB will be $$VB = \frac{1}{1+1} \times 300 = 150\ (V) \quad (3)$$

(The constant voltage Vc is expressed in absolute value). If the relationship between the resistors $R_1$ and $R_2$ and the constant voltage Vc is determined such that the value VB at this time may be lower than the dielectric breakdown voltage of the photosensitive layer 2, the phenomenon generally called biasing fall does not occur and also fogging does not occur. When the resistance Rd of the developer is changed to $10M\Omega$, the biasing voltage VB will become as determined by the above equation.

$$VB = \frac{10 + 1}{10 + 1 + 1} \times 300 = 275\ (V) \quad (4)$$

(The constant voltage Vc is expressed in absolute value)

The difference in voltage value obtained from the equations (3) and (4) is taken in charge of by the change of resistivity Rd of the developer, and accordingly the effective biasing voltage acting on the surface of the photosensitive layer and the surface of the developer layer is always maintained constant.

Under the assumption that the photoconductive layer 2 carrying negative electrostatic latent images is rotated clockwise, the sleeve 33 starts rotation synchronously with the rotation of the drum and the developer D attached on the sleeve 33 and by the action of the magnet 32 starts to move leftwards with rotation of the sleeve. The developer D is confined to a uniform developer layer by the bent portion of the base portion 31.

The developer is conveyed by rotation of the sleeve 33 while self-rotating by the action of alternate magnetic force provided by the magnet arrangement shown in FIG. 1, whereby a triboelectric charge is impressed on the toner.

At the position of A, developing is carried out.

No fogging occurs due to the biasing potential as mentioned as above. Image transfer and fixation are conducted by known methods.

As mentioned above, since a constant effective biasing potential is impressed to the toner interposed between the layer 2 and the developer at the developing position, independent of the change of characteristics of the developer, occurance of fogging is prevented and a visible image of high quality is obtained.

According to an experiment using the present invention, 10,000 copies of high quality are obtained, while only 5,000 copies can be obtained by the known development.

This invention will also be used in reversal development.

What is claimed is:

1. A control circuit used in development of electrostatic latent images comprising, a. a support bearing a photoconductive layer and connected to earth,
b. a developer comprising a toner and an electroconductive and magnetic carrier,
c. means for carrying the developer and forming a brush of the developer for contacting said photoconductive layer,
d. an electrode in contact with the developer and spaced from said photoconductive layer, said electrode also being spaced from said means for carrying the developer,
e. a first resistor connected to said electrode and to said support, and
f. an electric source for providing a potential between the support and the developer carrying means.

2. A control circuit used in development of electrostatic latent images according to claim 1, further comprising a second resistor connected between the connecting point of said support and said first resistor, and said electric source.

3. A control circuit used in development of electrostatic latent images according to claim 1, wherein the developer carrying means comprises a magnet, and an electroconductive sleeve covering the magnet and connected to said electric source.

4. A developing apparatus for electrostatic latent images carried on a photoconductive layer supported on an electroconductive base plate comprising:

a. a developer comprising a toner and an electroconductive and magnetic carrier, b. means for supporting the developer and forming a brush of the developer and contacting the developer to the photoconductive layer, c. two electric networks in parallel with each other, one of said electric networks comprising the resistances of said base plate; photoconductive layer, developer and said means for supporting the developer, the other of said networks comprising the resistances of a resistor, said developer and said means for supporting the developer, d. an electric source for providing a biasing potential between said base plate and said means for supporting the developer and between said resistor and said means for supporting the developer.

* * * * *